US008454206B2

(12) United States Patent
Chang

(10) Patent No.: US 8,454,206 B2
(45) Date of Patent: Jun. 4, 2013

(54) SURFACE LIGHT SOURCE DEVICE

(75) Inventor: Shao-Han Chang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 13/030,704

(22) Filed: Feb. 18, 2011

(65) Prior Publication Data

US 2012/0020069 A1 Jan. 26, 2012

(30) Foreign Application Priority Data

Jul. 26, 2010 (CN) ..... 2010 1 0236740

(51) Int. Cl.
*F21V 5/02* (2006.01)

(52) U.S. Cl.
USPC ..... 362/339; 362/246; 362/311.06; 362/351; 362/355; 362/431

(58) Field of Classification Search
USPC ..... 362/224, 246, 249.02, 268, 311.02, 362/311.06, 235, 431, 330, 331, 339, 355, 362/410, 351, 800
See application file for complete search history.

(56) References Cited

U.S. PATENT DOCUMENTS

| | | | | | |
|---|---|---|---|---|---|
| 4,175,661 | A * | 11/1979 | Barnes | ..... | 206/519 |
| 4,577,260 | A * | 3/1986 | Tysoe | ..... | 362/521 |
| 4,630,184 | A * | 12/1986 | Ferrero | ..... | 362/351 |
| 5,274,536 | A * | 12/1993 | Sato | ..... | 362/338 |
| 5,897,201 | A * | 4/1999 | Simon | ..... | 362/268 |
| 6,666,569 | B2 * | 12/2003 | Obata | ..... | 362/339 |
| 6,742,915 | B1 * | 6/2004 | Westerheide | ..... | 362/360 |
| 7,408,708 | B2 | 8/2008 | Goto et al. | | |

FOREIGN PATENT DOCUMENTS

CN 201155705 Y 11/2008

* cited by examiner

*Primary Examiner* — Bao Q Truong
(74) *Attorney, Agent, or Firm* — Altis Law Group, Inc.

(57) ABSTRACT

A surface light source device includes a lamp post, a number of light sources distributed in rows on the side surfaces of the lamp post, and a number of first prism sheets and second prism sheets arranged around the lamp post in that order. Each of the first prism sheets and the second prism sheets includes a light incident surface and a light exit surface opposite to the light incident surface. Each of the light exit surfaces includes a number of substantially parallel elongated protrusions, and the longitudinal directions of the elongated protrusions of the first prism sheet and the second prism sheet are substantially perpendicular to each other. The first prism sheets and the lamp post are approximately spaced by a first predefined distance, and the second prism sheets and the first prism sheets are approximately spaced by a second predefined distance.

7 Claims, 6 Drawing Sheets

SURFACE LIGHT SOURCE DEVICE

BACKGROUND

1. Technical Field

The present disclosure relates to surface light source devices and, particularly, to a surface light source device employing double prism sheets.

2. Description of Related Art

With the advantages of long service life, low pollution, and energy efficiency, light-emitting diodes have been widely used in lighting devices. The light-emitting diode is a point light source with a small radiation angle. A plurality of light-emitting diodes distributed in rows on the lighting device is usually needed to obtain a large lighting surface. However, the high brightness light-emitting diodes always cause light spots on the lighting surface of the lighting device. An extra light diffusion film is needed to reduce or eliminate the light spots and achieve a uniform lighting surface. However, the light diffusion film may absorb part of the light from the light-emitting diodes. Thus, the brightness of light illumination of the lighting device is reduced.

Therefore, what is needed is a surface light source device to overcome the above-mentioned shortcomings.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
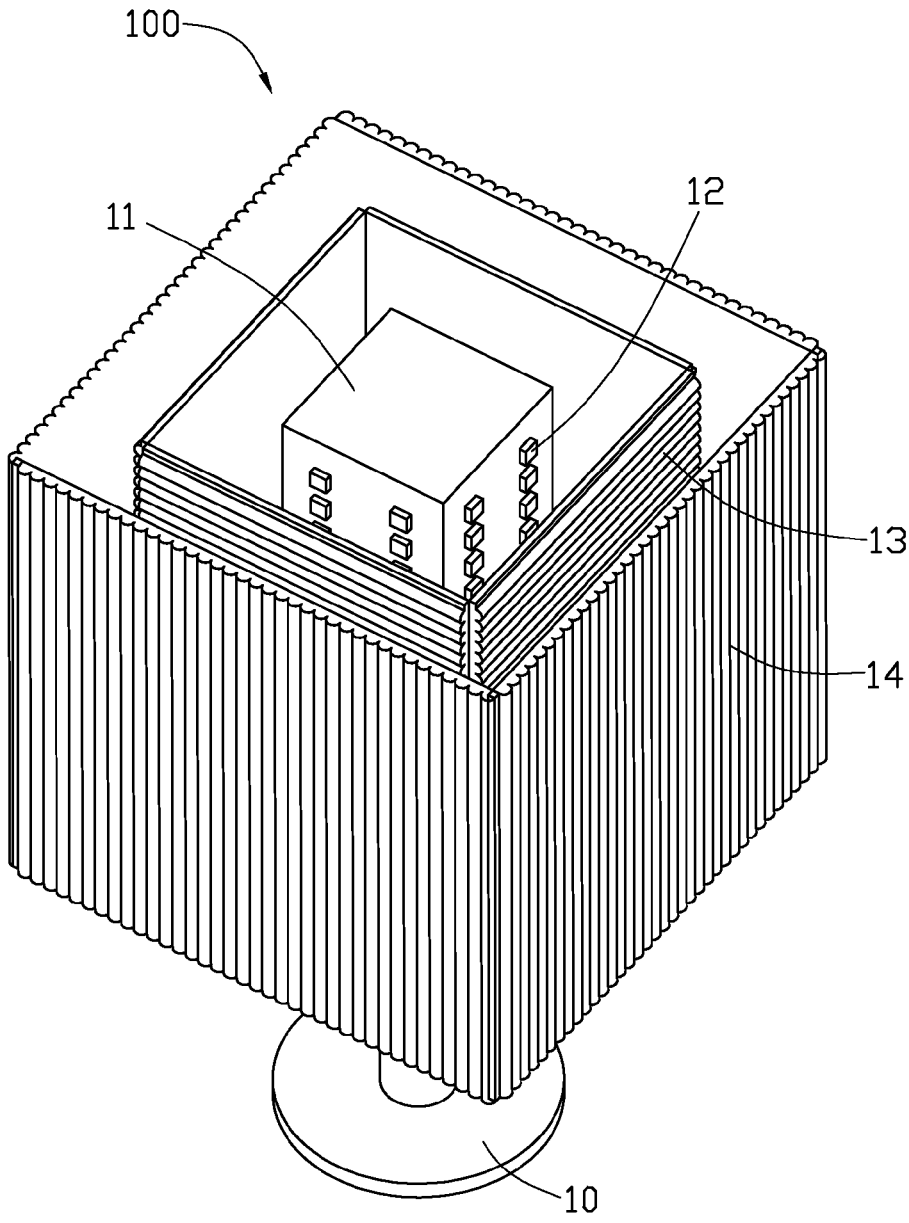
FIG. 1 is a schematic, isometric view of a surface light source device according to an embodiment.

Referring to FIG. 1, a surface light source device 100 is illustrated. The surface light source device 100 includes a lamp holder 10, a lamp post 11, a number of light sources 12, a number of first prism sheets 13, and a number of second prism sheets 14. The lamp post 11 is arranged on the lamp holder 10, and includes a number of side surfaces. The light sources 12 are distributed in rows on one or more of the side surfaces of the lamp post 11. In the embodiment, the light sources 12 are a number of point light sources, such as light-emitting diodes. A number of linear light sources, such as cold cathode tubes, can replace the point light sources 12. The lamp post 11 includes a number of highly reflective surfaces, which are used to reflect light from the light sources 12 to the first prism sheets 13.

The first prism sheets 13 are arranged around the lamp post 11, and the second prism sheets 14 are arranged around the first prism sheets 13. In the embodiment, the first prism sheets 13 and the lamp post 11 are approximately spaced by a first predefined distance, the second prism sheets 14 and the first prism sheets 13 are approximately spaced by a second predefined distance.

Figure 2:
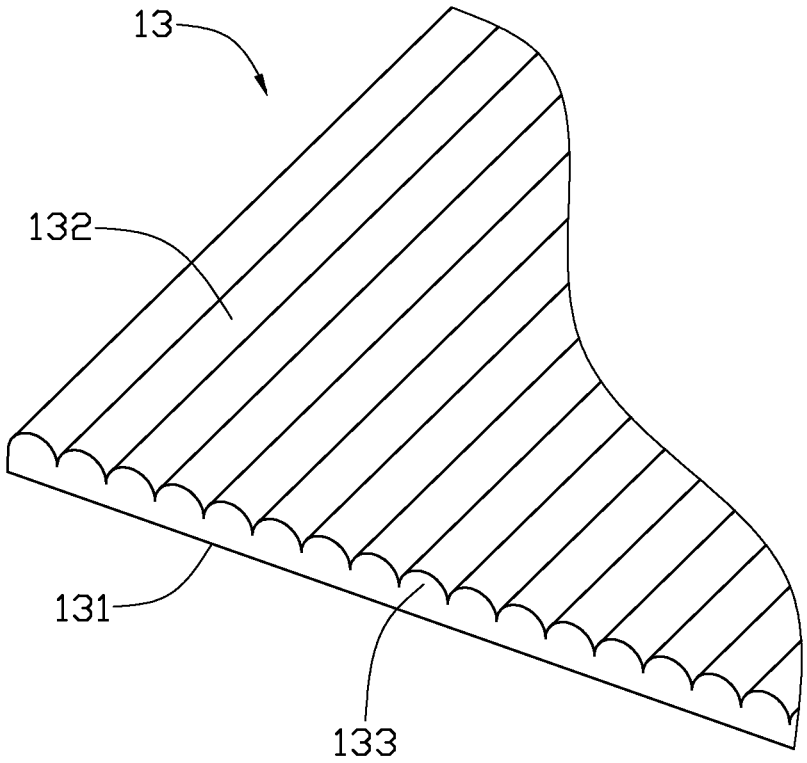
FIG. 2 is a partial view of a first prism sheet of the surface light source device of FIG. 1.

Referring also to FIG. 2, each of the first prism sheets 13 is made of transparent plastic material, which includes a light incident surface 131 and a light exit surface 132. The light incident surface 131 and the light exit surface 132 are at opposite sides of the first prism sheet 13. In the embodiment, the light incident surface 131 is a planar surface. The light exit surface 132 includes a number of substantially parallel elongated protrusions 133 distributed side by side to each other. The cross-section of each elongated protrusion 133 cut along a line perpendicular to the longitudinal direction of the protrusions 133 can be arc-shaped, oval-shaped, or wave-shaped.

Figure 3:
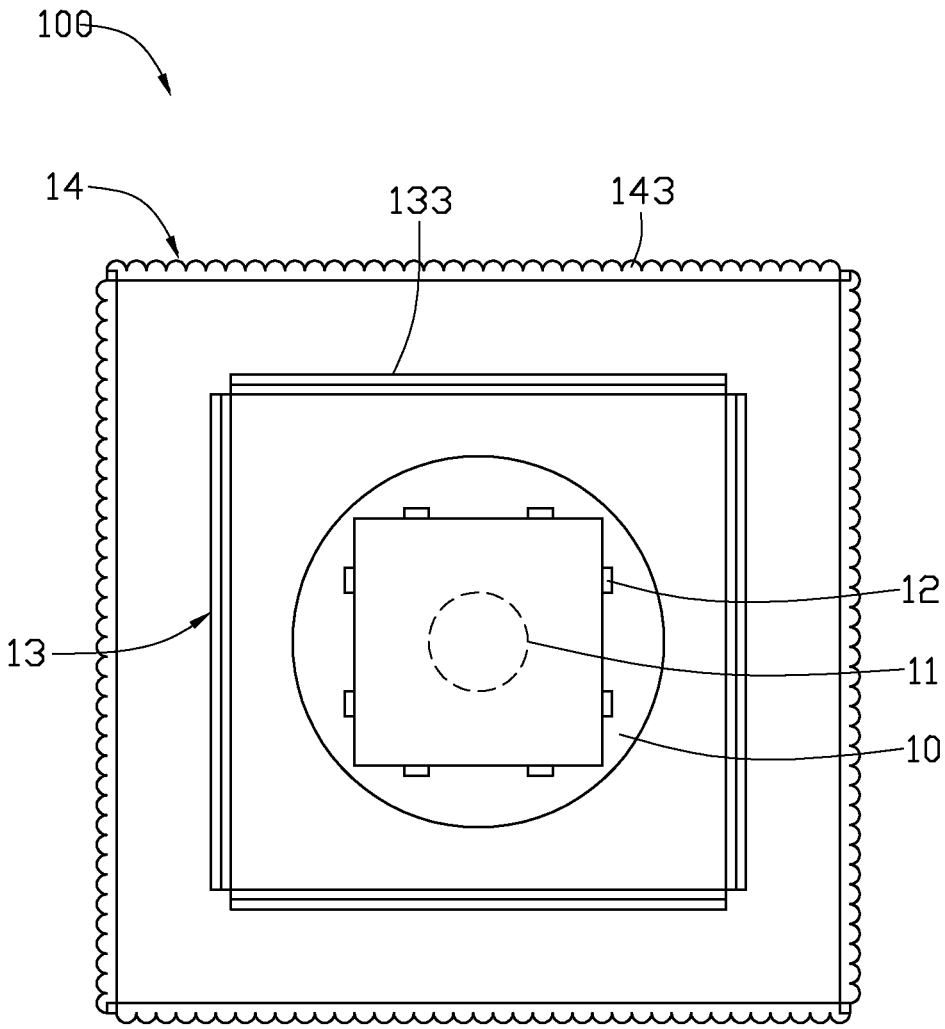
FIG. 3 is a top view of the surface light source device of FIG. 1.

Referring to FIG. 3, the structure of the second prism sheet 14 is similar to that of the first prism sheet 13, and is made of transparent plastic material. The light exit surface of the second prism sheet 14 includes a number of substantially parallel elongated protrusions 143. A cross-section of each elongated protrusion 143 cut along a line perpendicular to the longitudinal direction of the protrusions 143 can be arc-shaped, oval-shaped, or wave-shaped.

The light incident surfaces 131 of the first prism sheet 13 face the light sources 12, and the light exit surfaces 132 of the first prism sheet 13 face light incident surfaces of the second prism sheet 14. The longitudinal directions of the protrusions 133 and 143 are substantially perpendicular to each other. Come back to FIG. 1, in the embodiment, the longitudinal direction of each elongated protrusion 133 is substantially perpendicular to that of the lamp post 11, and the longitudinal direction of each elongated protrusion 143 is thus substantially parallel to that of the lamp post 11. In other embodiments, the longitudinal direction of each elongated protrusion 133 may be substantially parallel to that of the lamp post 11, and the longitudinal direction of each elongated protrusion 143 may be substantially perpendicular to that of the lamp post 11.

Because the elongated protrusions 133 and 143 on the light exit surface are curved, when light beams enter the first prism sheet 13 and the second prism sheet 14, incident light beams are refracted, reflected, and diffracted. As a result, light beams passing through the first prism sheet 13 and the second prism sheet 14 are more uniform than they are passing through a light exit surface of a convention optical plate.

Figure 4:
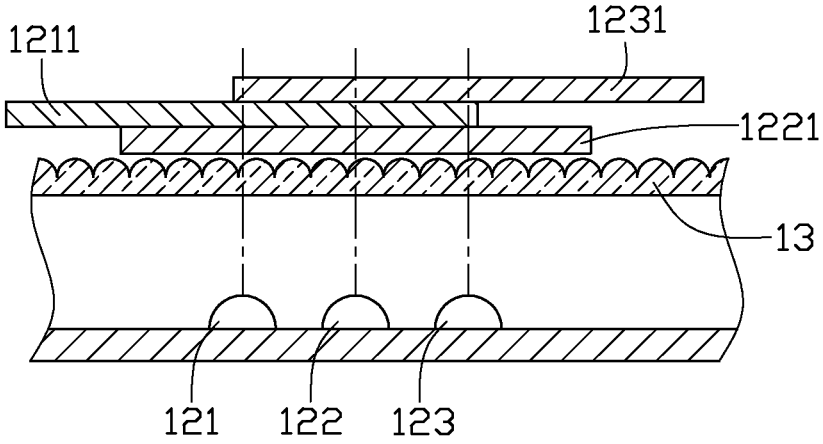
FIG. 4 is a schematic view showing light beams passing through the first prism sheet of FIG. 2.

In the embodiment, light beams from each light sources 12 each form a linear light source on the light exit surface 132 of the first prism sheet 13, and the longitudinal direction of each linear light source is substantially perpendicular to that of the protrusions 133. For example, as shown in FIG. 4, light beams from light sources 121, 122, and 123 passing through the first prism sheet 13 are refracted, reflected, and diffracted, to respectively form uniform linear light source 1211, 1221, and 1231 on the light exit surface 132.

Figure 5:
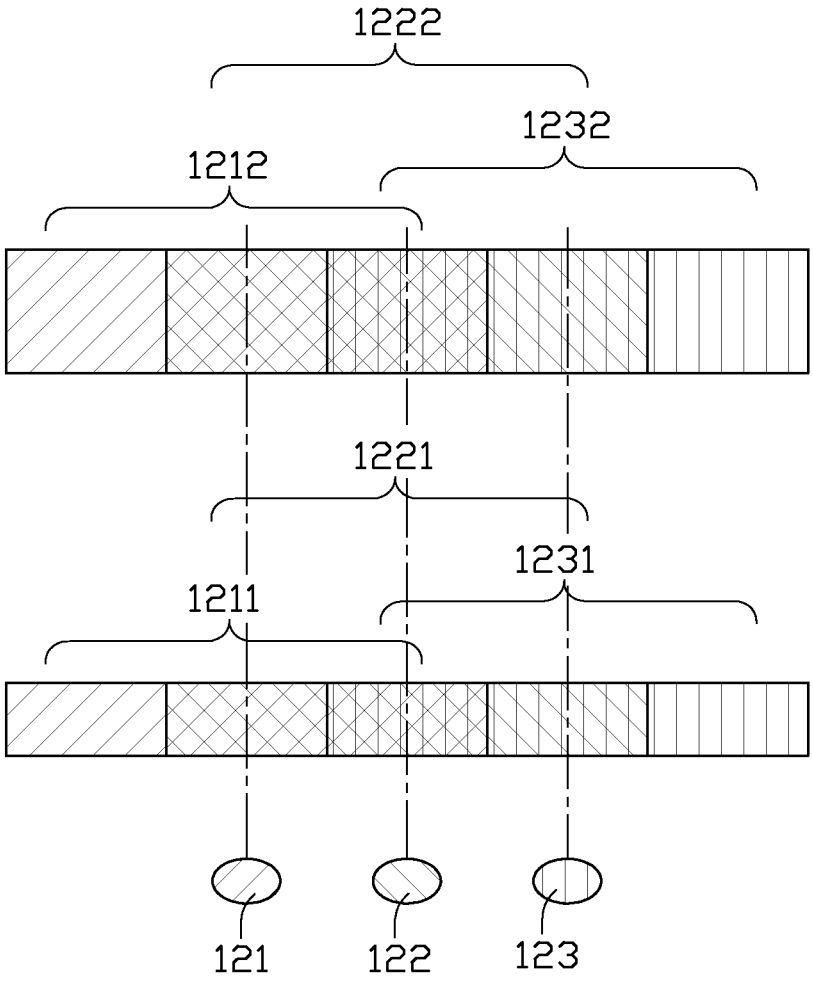
FIG. 5 is a schematic view showing light beams passing through the double prism sheets of the surface light source device.

Referring to FIG. 5, if the spacing between each two neighboring light sources 12 is small enough, the neighboring linear light sources, such as linear light sources 1211, 1221, and 1231, overlap in the first prism sheet 13 in their longitudinal direction to achieve a light mixing effect. If the first prism sheet 13 is spaced further from the light sources 12, the length of each linear light source is longer, and the linear light sources overlap more to achieve a better light mixing effect.

Further, light beams from each light sources 12 each form a band light source on the light exit surface of the second prism sheet 14, and the width of each band light source is substantially perpendicular to the longitudinal direction of the elongated protrusions 143. For example, as shown in FIG.

5, after passing through the second prism sheet 14, the linear light sources 1211, 1221 and 1231 formed on the first prism sheet 13 are further refracted, reflected, and diffracted, to respectively form uniform band light sources 1212, 1222 and 1232 along the width direction of the linear light sources on the light exit surface of the second prism sheet 14.

Figure 6:
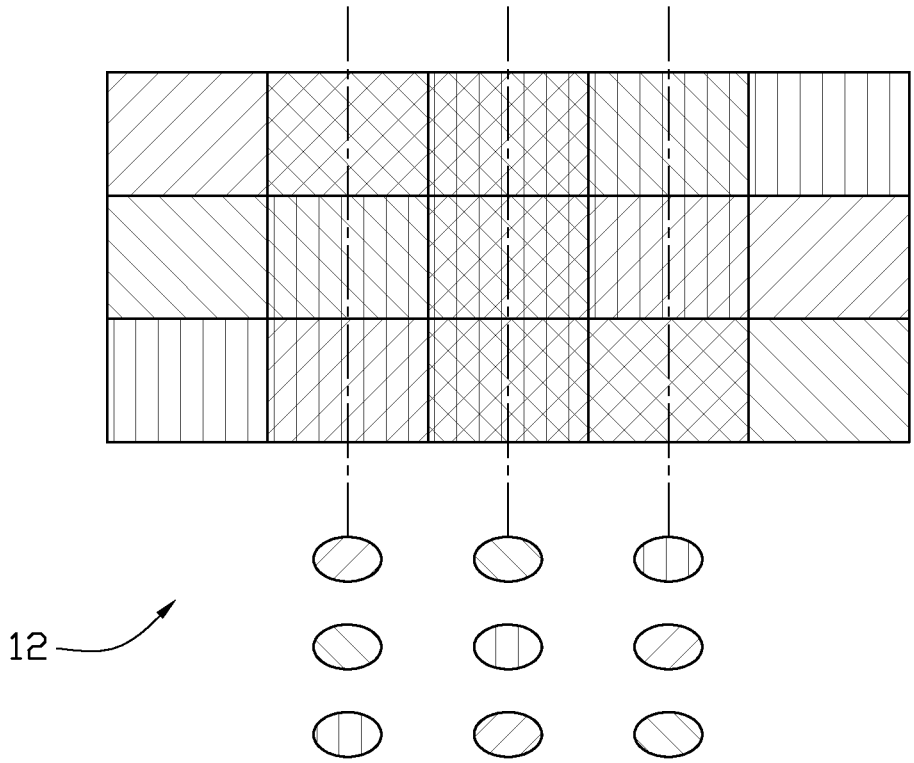
FIG. 6 is a schematic view showing light beams outputting from the surface of the light source device.

Referring to FIG. 6, if the spacing between each two neighboring light sources 12 is small enough, the neighboring band light sources, such as band light sources 1212, 1222, and 1232, overlap in the second prism sheet 14 in their width direction to achieve a uniform surface light source. If the second prism sheet 14 is spaced further from the first prism sheet 13, the width of each band light sources is wider, and the band light sources overlap more to achieve a more uniform surface light source.

The light sources 12 can be multi-colored light-emitting diode arrays such as red, green, and blue light-emitting diode arrays. In addition, the spacing between each two neighboring light sources 12 can be large enough such that the neighboring linear light sources do not overlap completely in the longitudinal direction on the first prism sheet 13, and the multi-colored light output from the second prism sheet 14 forms a gradient color surface light source to meet specific needs.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A surface light source device comprising:

a lamp post comprising a plurality of side surfaces;

a plurality of light sources distributed in rows on one or more of the side surfaces of the lamp post;

a plurality of first prism sheets arranged around the lamp post; and a plurality of second prism sheets arranged around the first prism sheets;

wherein, each of the first prism sheet and the second prism sheet comprises a light incident surface and a light exit surface opposite to the light incident surface;

each of the light exit surfaces of the first prism sheet and the second prism sheet comprises a plurality of substantially parallel elongated protrusions, and the longitudinal directions of the elongated protrusions of the first prism sheet and the second prism sheet are substantially perpendicular to each other;

the first prism sheets and the lamp post are approximately spaced by a first predefined distance, the second prism sheets and the first prism sheets are approximately spaced by a second predefined distance.

2. The surface light source device of claim 1, wherein a cross-section of each elongated protrusions of the first prism sheet and the second prism sheet, cut along a line perpendicular to the longitudinal direction of the elongated protrusions, is arc-shaped, oval-shaped, or wave-shaped.

3. The surface light source device of claim 1, wherein the longitudinal direction of each elongated protrusion of the first prism sheet is substantially perpendicular to that of the lamp post, and the longitudinal direction of each elongated protrusion of the second prism sheet is substantially parallel to that of the lamp post.

4. The surface light source device of claim 1, wherein the longitudinal directions of each elongated protrusion of the first prism sheet is substantially parallel to that of the lamp post, and the longitudinal directions of each elongated protrusion of the second prism sheet is substantially perpendicular to that of the lamp post.

5. The surface light source device of claim 1, wherein the light sources are a plurality of point light sources.

6. The surface light source device of claim 1, wherein the light sources are a plurality of linear light sources.

7. The surface light source device of claim 1, wherein the lamp post comprises a plurality of highly reflective surfaces to reflect light from the light sources to the first prism sheet.

* * * * *